US005778558A

United States Patent [19]

Wenger et al.

[11] Patent Number: 5,778,558

[45] Date of Patent: Jul. 14, 1998

[54] PELLET COOLING METHOD AND APPARATUS USING ALTERNATE HOT AND COOL AIR STREAMS

[75] Inventors: LaVon G. Wenger; Douglas S. Clark; Nicholas B. Scott, all of Sabetha, Kans.

[73] Assignee: Wenger Manufacturing, Inc., Sabetha, Kans.

[21] Appl. No.: 786,867

[22] Filed: Jan. 23, 1997

[51] Int. Cl.[6] ..... F26B 3/00

[52] U.S. Cl. ..... 34/506; 34/509; 34/66; 34/136; 34/172

[58] Field of Search ..... 34/506, 509, 65, 34/66, 129, 136, 168, 172; 110/281, 299, 291; 432/77, 78

[56] References Cited

U.S. PATENT DOCUMENTS

| | | | |
|---|---|---|---|
| 1,158,624 | 11/1915 | Brantingham | 34/574 |
| 1,276,044 | 8/1918 | Ellis et al. | 34/174 |
| 2,148,946 | 2/1939 | Hubmann et al. | 34/170 |
| 2,577,315 | 12/1951 | Ellerbeck | 222/135 |
| 2,861,356 | 11/1958 | Lellep | 34/174 |
| 3,241,248 | 3/1966 | Gerlach et al. | 34/168 |
| 3,571,946 | 3/1971 | Essen | 34/591 |
| 3,833,137 | 9/1974 | Mathews | 34/168 X |
| 4,086,708 | 5/1978 | Westelaken | 34/65 |
| 4,090,852 | 5/1978 | Dowd | 34/584 X |
| 4,379,368 | 4/1983 | Keller | 34/584 |
| 4,402,143 | 9/1983 | Schulz et al. | 34/584 |
| 4,445,282 | 5/1984 | Heinemans | 34/168 |
| 4,458,428 | 7/1984 | Saeman | 34/506 |
| 4,530,169 | 7/1985 | Okawara | 34/582 |
| 4,683,665 | 8/1987 | Geelen | 34/65 |
| 4,869,162 | 9/1989 | Schouten | 34/168 X |
| 4,887,364 | 12/1989 | Geelen | 34/583 |

FOREIGN PATENT DOCUMENTS 293976 8/1994 European Pat. Off. .

9801 of 1912 United Kingdom .

OTHER PUBLICATIONS

Donmar Cooler Information ; UAS Industries; Verti–Cooler, dated Oct. 1994.

*Primary Examiner*—Henry A. Bennett
*Assistant Examiner*—Steve Gravini
*Attorney, Agent, or Firm*—Hovey, Williams, Timmons & Collins

[57] ABSTRACT

A pellet conditioning device (10) for the cooling and/or drying of preformed discrete pellets (148) is provided which includes an upright pellet-receiving bin (12) with a dual grate assembly (18) therein. The assembly (18) includes a stationary first grate comprising a plurality of upright, apertured grate wall members (86), and a shiftable second grate including a plurality of elongated, obliquely oriented plates (106) located between and in spanning relationship to adjacent pairs of the wall members (86). Shifting structure (20) is provided for selective and sequential translational, rectilinear shifting movement of the lower margins (110) of the plates (106) so as to successively open and close a pellet passageway (117) adjacent each lower margin (110). A duct and fan arrangement (38) is also provided with the bin (12) so as to draw cooling air currents through the grate assembly (18) and pellets (148) therein. The plates (106) may also be shifted upwardly to their maximum extent in order to dislodge pellet bridges above the grate assembly (18). In another embodiment a conditioning device (12*a*) includes alternately operable hot and cool air introduction assemblies (152, 154) disposed along the opposed ends of bin (12*a*). In operation, relatively hot air currents are delivered beneath the grate assembly (18) via assembly (152), whereupon the later is closed; the cool air inlet assembly (154) is then opened so as to cause introduction of ambient air into and through the bin (12*a*).

13 Claims, 7 Drawing Sheets

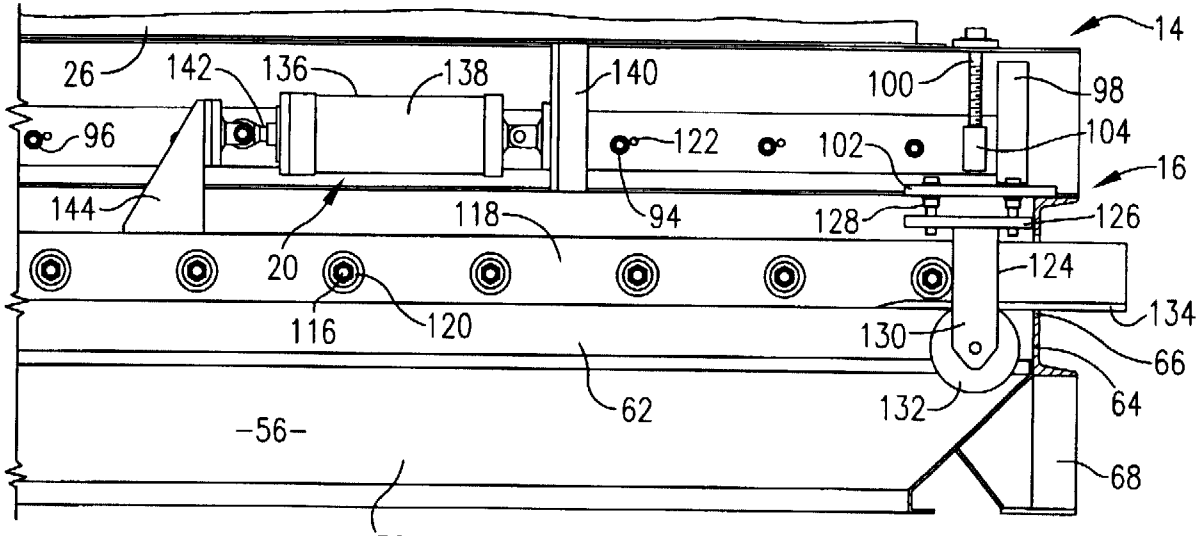
FIG. 5.
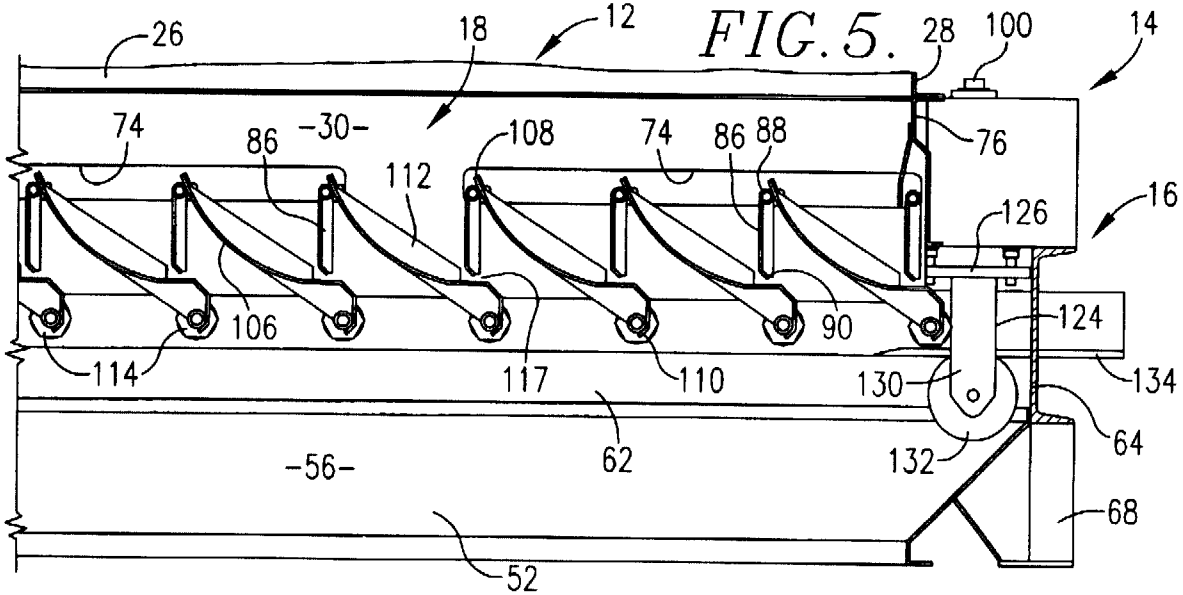
FIG. 4.
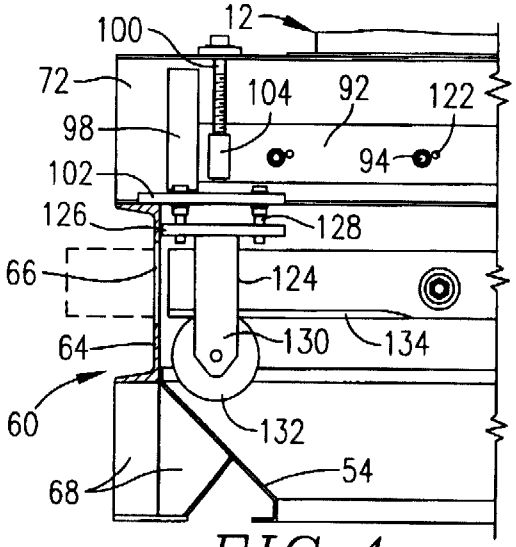
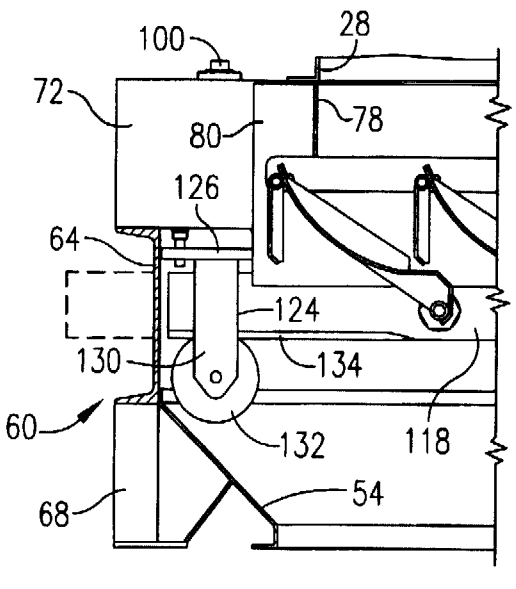

PELLET COOLING METHOD AND APPARATUS USING ALTERNATE HOT AND COOL AIR STREAMS

BACKGROUND OF THE INVENTION

1. Field of the Invention

The present invention is broadly concerned with an improved device for conditioning of preformed, discrete bodies such as feed pellets in order to cool and/or dry the pellets for subsequent storage or packaging. More particularly, the invention pertains to a device of this character which includes an upright bin with a selectively operable dual grate assembly within the bin for holding the pellets and permitting timed discharge thereof after conditioning. The dual grate assembly includes a stationary grate comprising a plurality of elongated, upright, laterally spaced apart wall members, and a second grate made up of elongated, obliquely oriented plates spanning adjacent pairs of the first grate wall members; shifting means is also provided for successively opening and closing a passage way for the conditioned pellets between the lower ends of the wall members and the adjacent lower portions of the plates. In an alternate embodiment the device is designed to alternately deliver relatively hot and relatively cool currents of air beneath the grate assembly for passage upwardly through the pellets; in this fashion the twin goals of drying and cooling the pellets may be more efficiently achieved.

2. Description of the Prior Art

Agricultural feed pellets are commonly produced using high capacity pellet mills or extrusion-type apparatus. After production, these pellets are generally warm and of relatively high moisture content. As such, they are unsuitable for long term storage and must be conditioned to cool and/or dry the pellets down to an appropriate temperature and moisture level.

It has been known to make use of multiple-stage hot air dryers for the conditioning of pellets and other feed products. In such dryers the warm, moist pellets are fed onto a moving, serpentine belt and warm air currents are drawn upwardly through the dryer as the pellets traverse the stages thereof. While dryers of this type produce acceptable end products, they are relatively expensive to purchase and operate.

U.S. Pat. No. 4,683,665 describes a pellet cooling device in the form of a large, upright bunker equipped with an internal three-grate apparatus therein designed to hold pellets to be cooled and to successively discharge portions of the pellets as they are sufficiently cooled. Similarly, U.S. Pat. No. 4,887,364 discloses a bunker-type pellet cooler equipped with a single grate including a series of pivoting bar members having overlapping-plate sections.

Bunker-type coolers as described in the '665 and '364 patents are deemed deficient in that the grate designs are relatively costly and complex. Moreover, these grate designs lack any means for effectively dislodging bridges or collections of pellets which can form above the grate and impede free flow of pellets therethrough.

SUMMARY OF THE INVENTION

The present invention overcomes the problems outlined above and provides a pellet conditioner for the cooling and/or drying of discrete bodies such as pellets. The device of the invention includes an upright bin with a dual grate assembly therein intermediate the inlet and outlet of the bin. The grate assembly broadly includes a pair of elongated, upright, laterally spaced apart wall members each presenting an upper and a lower end, with an elongated, obliquely oriented plate having an upper margin and an opposed lower margin. The plate is mounted between and in spanning relationship to the wall members, with the upper margin of the plate proximal to the upper end of one of the wall members, with the lower margin of the plate proximal to the lower end of the other of the wall members. In this manner, the wall members and oblique plate cooperatively define a concave region for holding a quantity of discrete bodies to be conditioned. In order to permit flow of air through the grate assembly, the upright walls and/or plates are perforated to present airflow passageways. Shifting means is operatively coupled with the dual grate assembly for selectively and successively opening and closing a passageway for the bodies between the lower margin of the plate and the proximal wall member to allow portions of the discrete bodies to pass through the grate device. Air flow means is normally operatively coupled with the bin for causing passage of conditioning air currents through the air flow passageways and pellets.

In actual practice, the grate assembly of the invention includes a plurality of the upright, laterally spaced apart wall members with a corresponding number of obliquely oriented plates between and in spanning relationship to each adjacent pair of the wall members. In such a construction, the shifting means is designed to simultaneously open and close respective passageways between the lower margins of the plates and the proximal wall members.

In preferred forms, the shifting means includes structure for selective translational movement of the oblique plates for opening and closing of the pellet passageways. In particular, this structure comprises apparatus for substantially rectilinear shifting movement of the lower margins of the plates toward and away from the proximal wall members and along a path of travel transverse to upright plains occupied by the wall members, the upper margins of the plates moving downwardly and upwardly as the lower margins thereof are shifted toward and away from the proximal wall members.

The oblique plates making up the second grate are preferably arcuate in cross-section and have the upper margins thereof in engagement with the upper ends of adjacent wall members. The preferred upright wall members comprising the first grate assembly, while stationary during operation of the conditioning device, are vertically adjustable so as to permit treatment of pellets of varying size.

In another preferred form, the bin is equipped with opposed hot air and cool air inlet structure so as to permit alternate introduction of heated and cool (usually ambient) air currents upwardly through the grate assembly and pellets within the bin. In this fashion a single device can be used for efficient drying and cooling of incoming pellets.

BRIEF DESCRIPTION OF THE DRAWINGS

FIG. 4 is a fragmentary side sectional view illustrating the frame and shifting structure forming a part of the dual grate assembly;

FIG. 5 is a fragmentary side sectional view depicting the configuration of the dual grate members in the closed position of the grate assembly;

DETAILED DESCRIPTION OF THE PREFERRED EMBODIMENT

Figure 2:
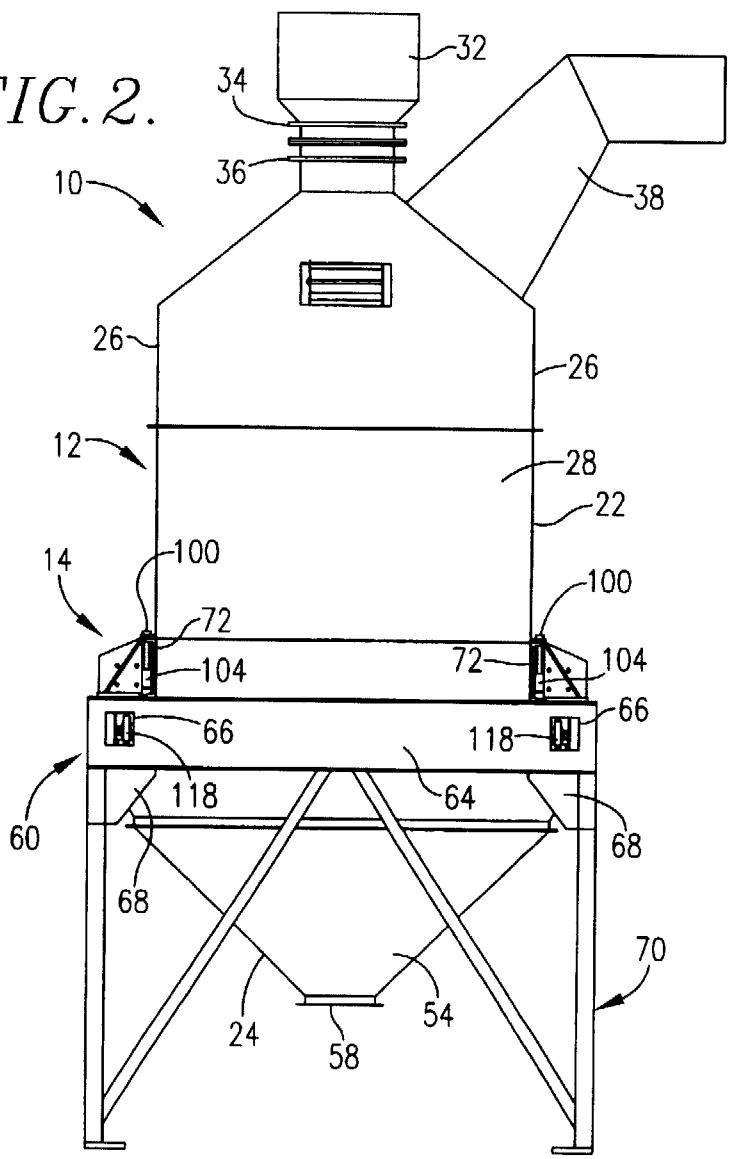
FIG. 2 is an end view of the device of FIG. 1.
Figure 1:
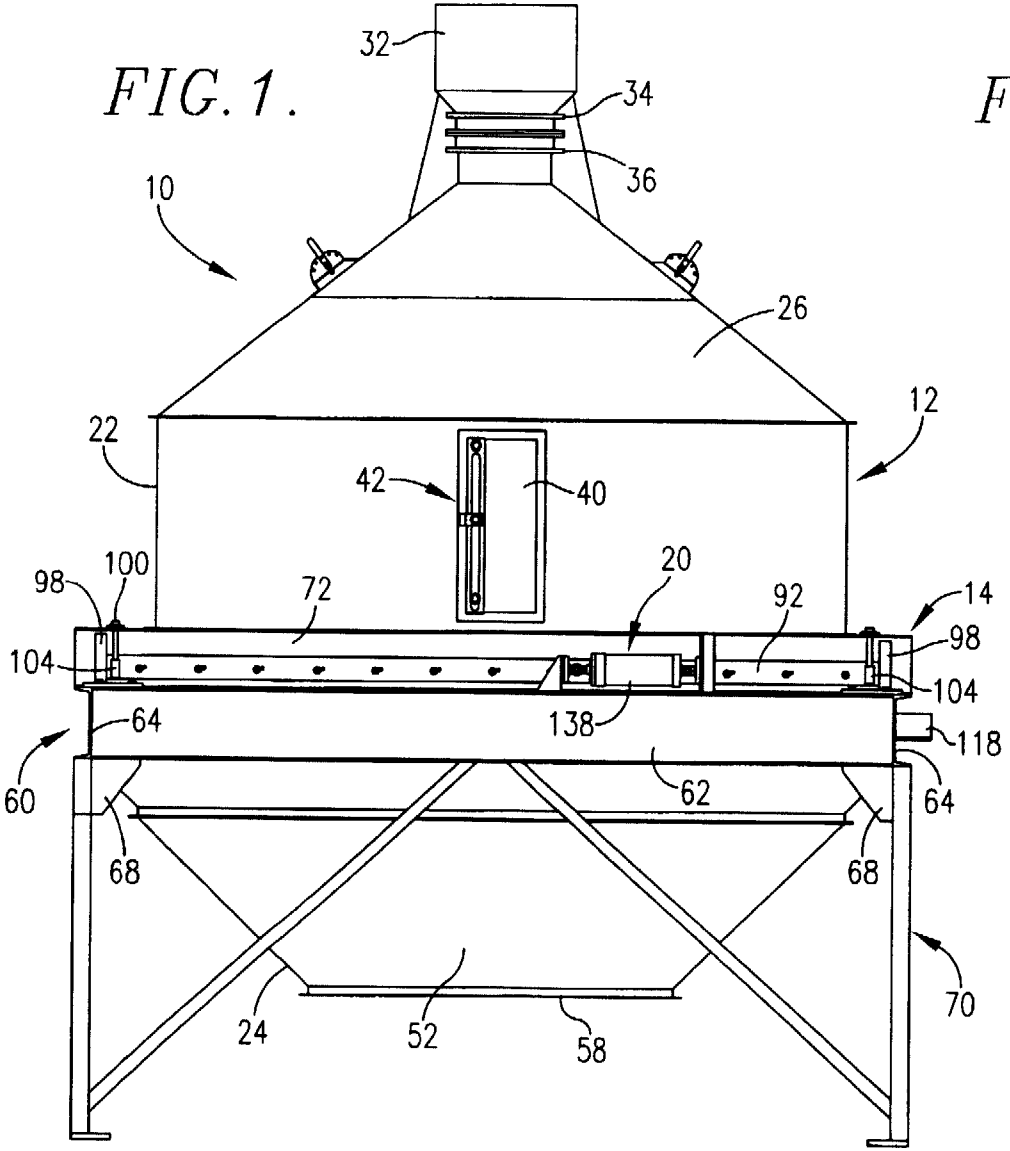
FIG. 1 is a side view of a preferred pellet conditioning device in accordance with the invention.

The pellet conditioning device 10 of the invention broadly includes an upright hopper or bin 12 equipped with an internal grate 14 for holding a supply of pellets within the bin 12 during conditioning operations, and for permitting selective gravitational passage of conditioned pellets through the grate 14 as required. The grate 14 includes a frame 16, a dual grate assembly 18 supported by the frame 16, and shifting structure 20 operably coupled with assembly 18 for selective opening and closing of the latter.

In more detail, the bin 12 includes an upper section 22 and a lower section 24 each coupled to the frame 15. Upper section 22 has sectionalized side and end walls 26, 28 which cooperatively present a large hollow internal region 30 above grate 14 (see FIG. 4). The upper ends of the walls 26, 28 are tapered at their upper ends as shown, and terminate in an uppermost, upstanding, tubular pellet inlet 32, the latter being equipped with a pair of slide gates 34, 36 to control entry of fresh pellets into device 10. The tapered upper portion of one sidewall 26 (FIG. 2) includes an obliquely oriented duct adapted to be coupled with fan means for drawing air currents through the grate 14 of device 10. In addition, the opposite sidewall 26 has a viewing window 40 therein and also supports conventional sensors 42 for automatic sensing of the quantity of pellets within the bin 12; such sensors are coupled via an appropriate microprocessor (not shown) with shifting structure 20 so as to permit automated pellet throughput control for the device 10.

The lower bin section 24 also includes sectionalized, converging side and end walls 52, 54 which cooperatively define a pellet-receiving zone 56 (FIG. 6) below grate 14; the walls 52, 54 terminate in a lowermost rectangular pellet outlet 58.

Figure 6:
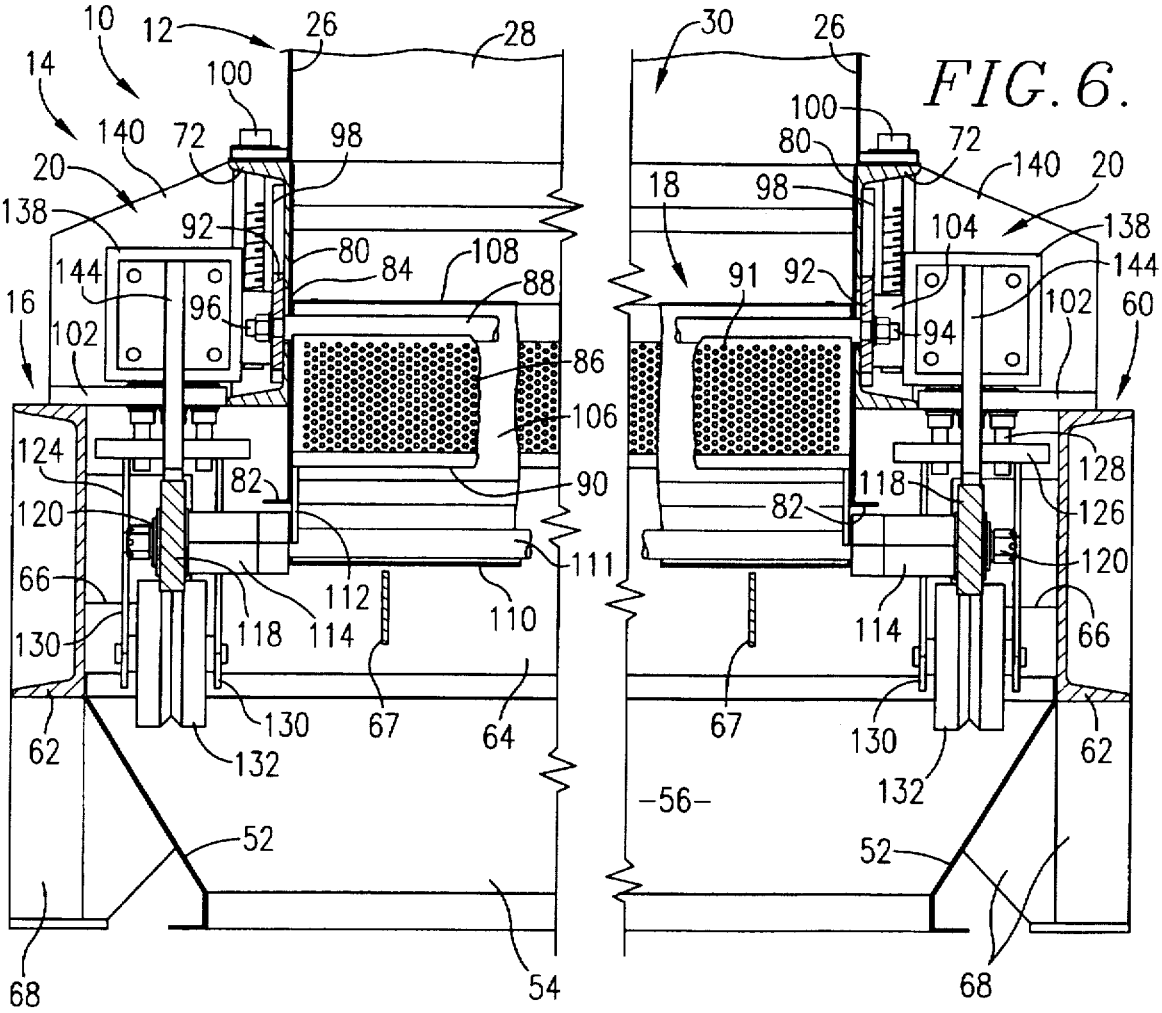
FIG. 6 is a fragmentary end sectional view illustrating the details of the dual grate assembly of the invention.

The frame 16 is generally situated between the upper and lower bin sections 22, 24 and includes a primary frame 60 made up of interconnected side channels 62 and end channels 64, the latter having end openings 66 therethrough. A pair of elongated metallic webs 67 (FIG. 6) extend between the channels 64, and are parallel with channels 62. Four leg mounts 68 are secured to the underside of frame 60 at the corners thereof. The mounts 68 are in turn coupled with a leg assembly 70 which supports device 10 and elevates bin 12 so that outlet 58 is above the floor. As best seen in FIG. 6, the lower bin section walls 52, 54 are secured to the inner faces of the channels 62, 64, adjacent the lower margins thereof.

The overall frame 16 further includes a pair of side channels which are inboard of and parallel with channels 62, and are secured at their ends to the channels 64. The upright web of each channel 72 has a total of three axially aligned, elongated slots 74 therethrough which are important for purposes to be described. The side walls 26 of upper bin section 22 are secured to the upper flanges of the channels 72. The end walls of the section 22 are coupled with a depending, bifurcated, airflow-blocking end wall extension 76 (FIG. 8), and with an airflow-blocking angle extension 78; the extensions 76, 78, extend between and are coupled to the inner faces of the side channels 72. As best seen in FIG. 6, the channels 72 also support a pair of depending, airflow-blocking sheet metal bin extensions 80 which extend from the upper flaps thereof to a point astride the grate assembly 14 where they terminate with flanged portions 82. The extensions are slotted as at 84 to present three elongated slots in registry with the slots 74 of channels 72.

Figure 7:
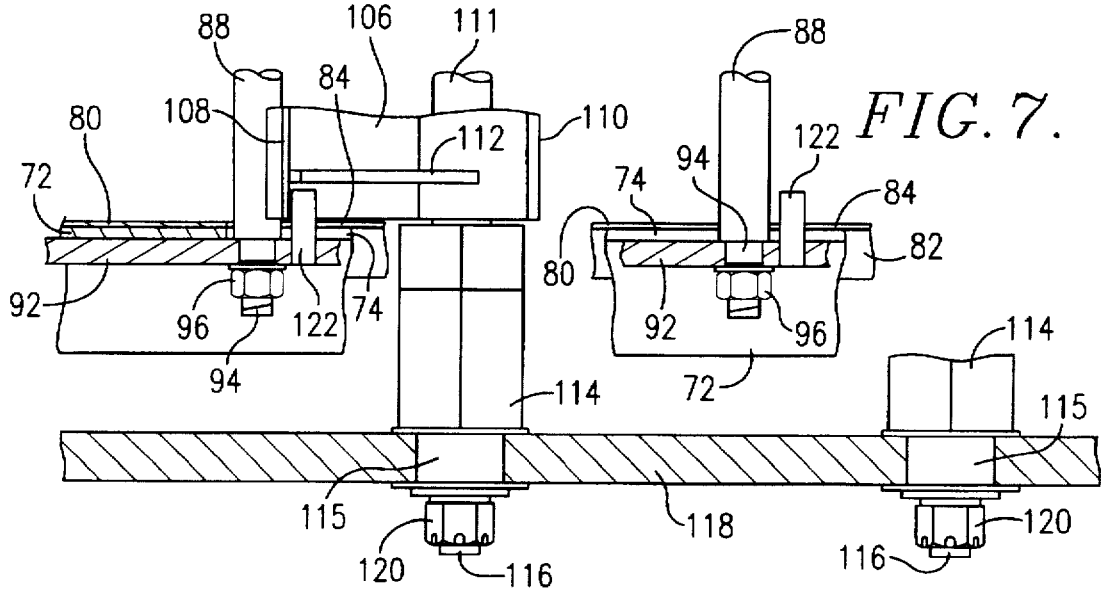
FIG. 7 is an enlarged fragmentary top view depicting the mounting arrangement for the dual grate members.

The dual grate assembly has a plurality of elongated, upright, laterally spaced apart, perforated, vertically adjustable but stationary in use wall or grate members 86 each presenting a rounded uppermost bearing region or end 88 and a lower end 90. Each of the members 86 is supported adjacent the opposite face of the vertical web of each channel 72. Specifically, the opposed ends of each upper bearing region 88 include a short threaded rod 94 which extends through the adjacent slots 84 and 74 in the extension 80 and channels 72, and through the associated bar 92 (FIG. 7). A nut 96 on the rod 94 completes the connection of the members 86 to the bars 92. Each bar 92 is supported for vertical adjustment on the channels 72 by means of a pair of endmost upright guides 98 and associated screw adjustments 100, the latter having uppermost hexagonal adjustment heads as shown. As best seen in FIGS. 4 and 6, the guides 98 are supported on respective metallic corner plates 102 secured to the lower flanges of the channels 72, whereas the adjustments 100 include threaded receivers 104 affixed to the channels 72 and receiving the respective adjustment bolts.

The assembly 18 also has a second grate composed of a plurality of elongated, arcuate in cross-section, obliquely oriented pans on plates 106 each presenting an uppermost margin 108 and a lower connection margin 110 having a transverse shaft 111. Each plate 106 has four spaced-reinforcing gussets 12 welded to the concave face thereof with a pair of lower, outwardly extending hexagonal mounting adaptors (FIG. 7) secured to the ends of shaft 111. The adaptors 114 terminate in a bearing 115 and a threaded stub shaft 116.

The plates 106 are mounted in spanning relationship between each adjacent pair of upright grate members 86 as shown, i.e., the upper end 108 of each plate 106 is adjacent and engages the upper bearing end 88 of one of the grate members 86 (as viewed in FIG. 5, the left-hand grate member of each pair), with the corresponding lower margin 110 being adjacent and directly below the lower end 90 Of the other grate member 86 (i.e., the right-hand grate member of each pair as shown in FIG. 5). It is to be noted that there is a gap 117 between the lower margin 110 of each plate 106 and the adjacent lower end 90 of the proximal superposed grate member 86.

The plates 106 are supported by means of a pair of shiftable, apertured rails 118 respectively disposed inboard of each side channel 62. As illustrated in FIGS. 4–7, the rails 118 receive the bearings 115 and stub shafts 116, and the connection thereto is completed by nut and washer assembly 120. The upper margins 108 of the plates 106 are maintained in bearing engagement with the corresponding ends 88 during movement of the pellets by means of short guide pins 122 affixed to and inwardly extending from each bar 92.

The shifting structure 20 includes a roller support 124 adjustably secured to and depending from each corner plate 102. In particular, each support 124 has an upper plate 126 secured to plate 102 by means of adjustment bolts 128, with a pair of downwardly extending roller-supporting webs 130 depending from the plate 126. The webs 130 in turn rotatably support a grooved wheel 132.

The ends of each rail 118 are supported by a corresponding wheel 132 so as to permit fore and aft translational shifting movement of the rails 118 and thus the lower margins 110 of the plates 106. To this end, the rail ends are beveled as at 134 (FIGS. 4–5). It will be appreciated that shifting movement of the rails 118 is accommodated by the openings 66 provided in the end channels 64.

Figure 3:
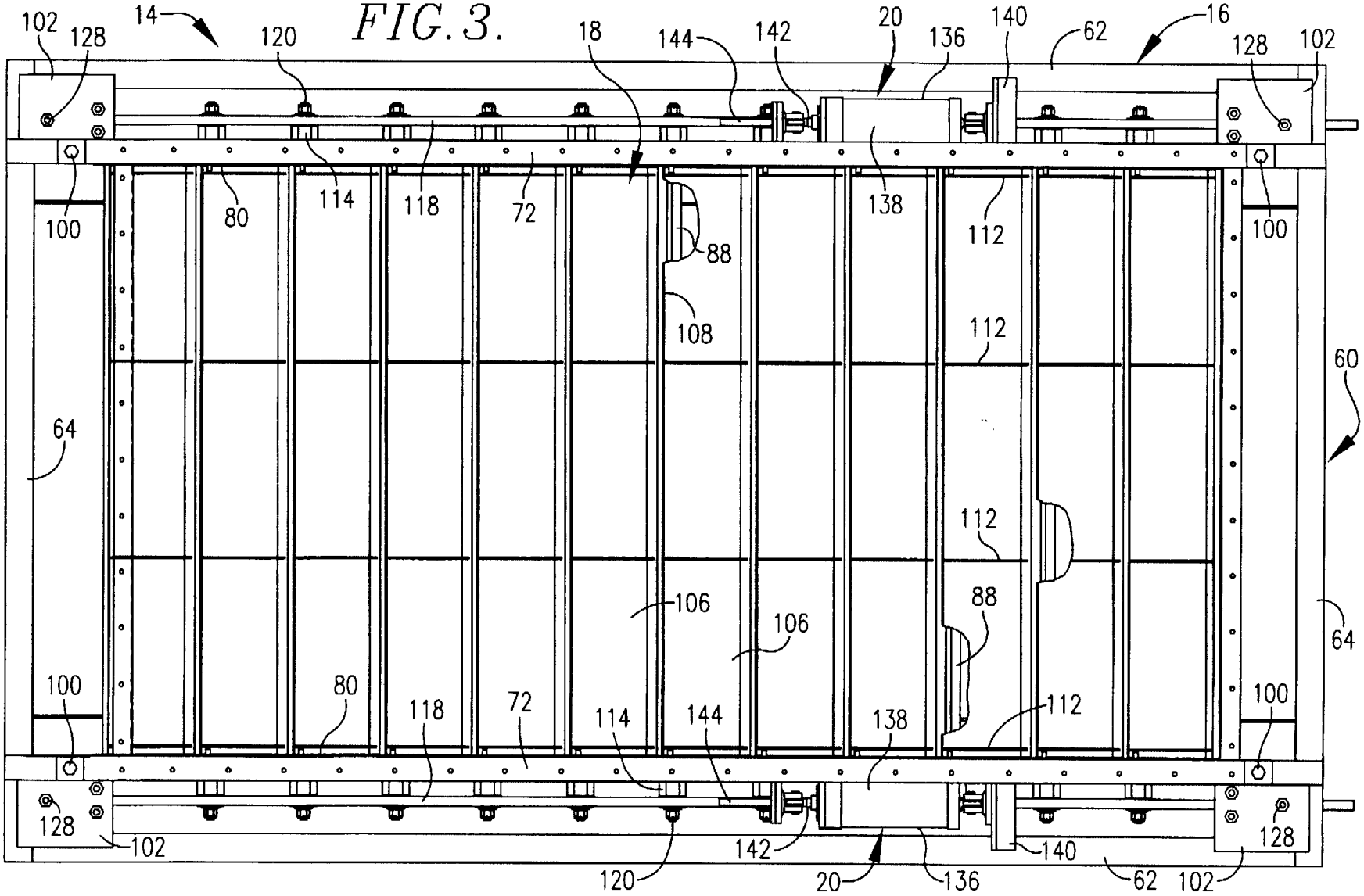
FIG. 3 is a top view, with parts broken away, of the dual grate assembly forming a part of the preferred pellet conditioning device.

The shifting structure 20 also includes a pair of piston and cylinder assemblies 136 respectively disposed outboard of each bar 92 and operated in unison. As best seen in FIGS. 3–4, the end of each cylinder 138 is pivotally coupled to an upright 140 secured to the adjacent channel 72, whereas the extensible and retractable piston rod 142 thereof is likewise pivotally mounted to an upright drive plate 144; each drive plate is welded to the upper edge of the underlying shiftable rail 118. Thus, shifting of the rod 142 effects corresponding translational moment of the rails 118 and hence the lower margins 110 of the plates 106.

Figure 8:
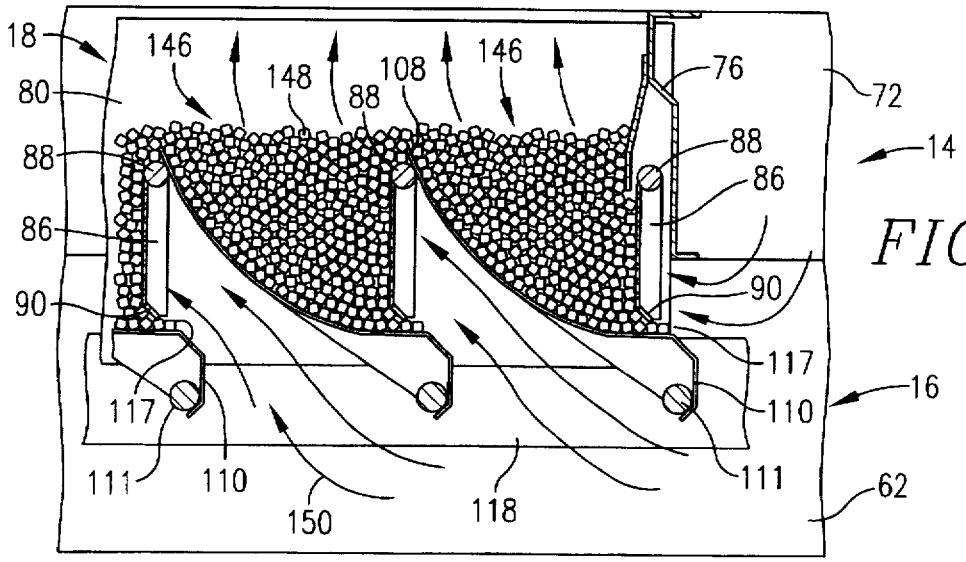
FIG. 8 is a fragmentary, schematic side view illustrating a portion of the dual grate assembly, during pellet conditioning operations with the grate assembly in its closed position.
Figure 9:
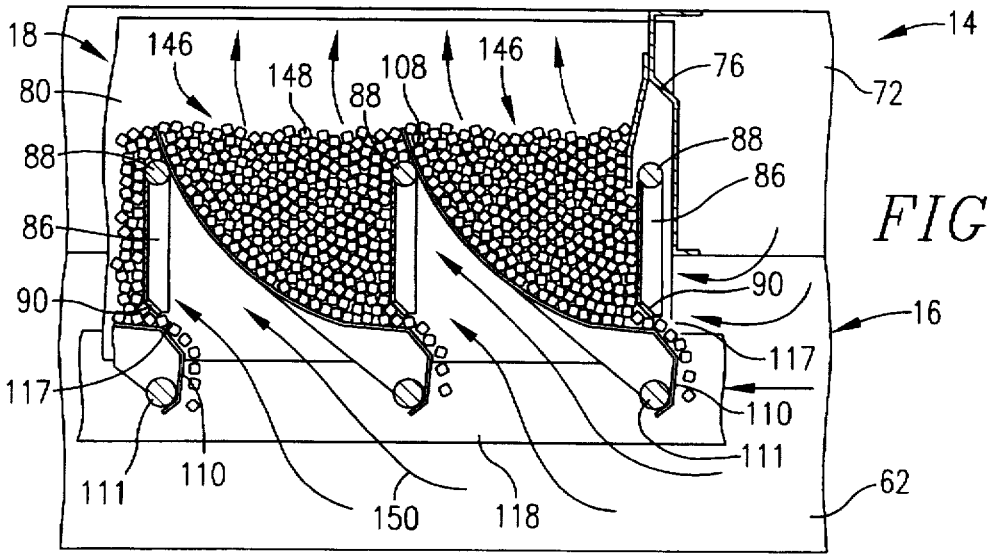
FIG. 9 is a view similar to that of FIG. 8, but showing the arcuate grate-defining plates shifted away from the upright grate members to permit passage of pellets through the grate assembly.
Figure 10:
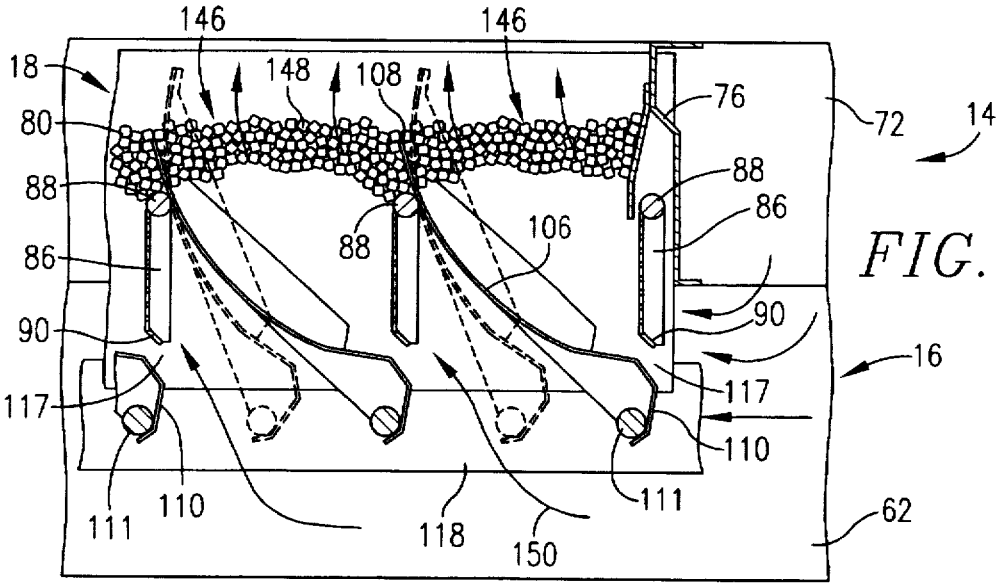
FIG. 10 is a view similar to that of FIG. 8, but showing the arcuate grates shifted to their maximum extent so as to dislodge a bridging of pellets within the conditioning device above the grate assembly.

Attention is next directed to FIGS. 8–10 which depict the typical operation of the dual grate assembly 18. As shown in FIG. 8 (where the assembly 18 is closed), the upright walls 86 and plates 106 cooperatively define a series of side-by-side, upwardly opening concave regions 146 for holding quantities of pellets 148 to be conditioned (it will of course be understood that the level of pellets 148 would extend upwardly above the regions 146 to fill a substantial portion of upper section 22 of bin 12).

The initial pellet gap 117 between the lower ends 90 of grate walls 86 and the lower margins 110 of plates 106 is set by the vertical adjustment of the grate walls 86. This is initially set manually by appropriate rotation of the corner mounted adjustment bolts 100. The gap 117 is designed to substantially prevent passage of the pellets 148 therethrough when the grate assembly 18 is in its FIG. 8 position.

Air currents 150 are normally continuously drawn through the apertured wall members 86 as shown, by means of duct 38 and its associated fan means. The air-blocking bin wall extension 76-80 described above assure that air is drawn through the sides and ends of device 10 below the grate assembly 18 for passage through the latter and thence upwardly through the mass of pellets 148.

FIG. 9 depicts the orientation of grate assembly 18 when the lower margin 110 of plates 106 are shifted leftwardly to enlarge the gap 117, thus affording a passageway for pellets 148 to descend from the assembly 18 and through the lower section 24 of bin 12. The translation of the lower margins 110 is accomplished by corresponding extension of the piston rods 142 effecting shifting movement of the rails 118, as will be readily appreciated from the foregoing description.

Back-and-forth translational movement of the plate ends 110 is thus sequentially carried out to deliver portions of cooled and conditioned pellets 148 from grate assembly 118. In one exemplary application, the plates 106 were shifted every eight seconds between the FIG. 8 and FIG. 9 positions, with a two second hold at the open FIG. 9 position. During such back-and-forth movement, the upper ends 108 of the plates 106 are captively retained between each respective bearing end 88 and the adjacent guide pin 122.

It sometimes occurs that the pellets 148 may form a "bridge" above the assembly 18, thus impeding free flow of pellets through the device 10. When such happens, the plates 106 may be shifted to their maximum extent as shown in FIG. 10 so as to disrupt and dislodge the bridge. In particular, such plate movement causes a significant upward thrusting movement of the ends 110 of the plates 106, thus effectively dislodging the pellet bridge.

Figure 12:
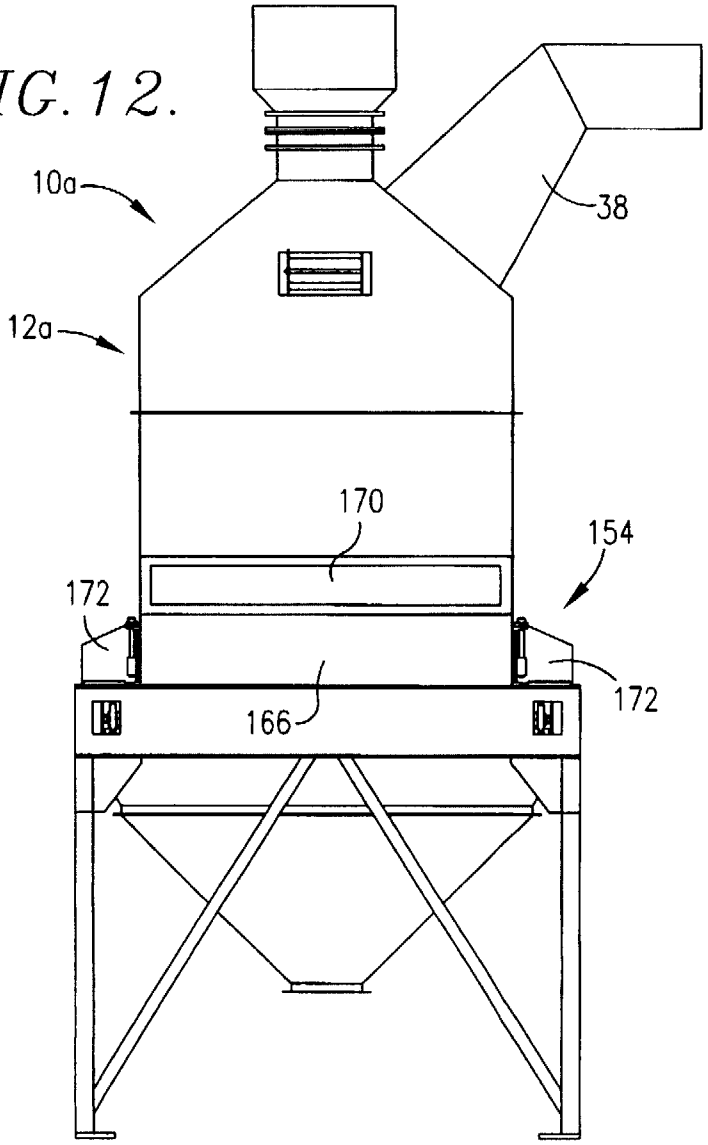
FIG. 12 is an end view similar to that of FIG. 2 but illustrating the FIG. 11 embodiment wherein the cool air inlet structure end of the device is shown.
Figure 11:
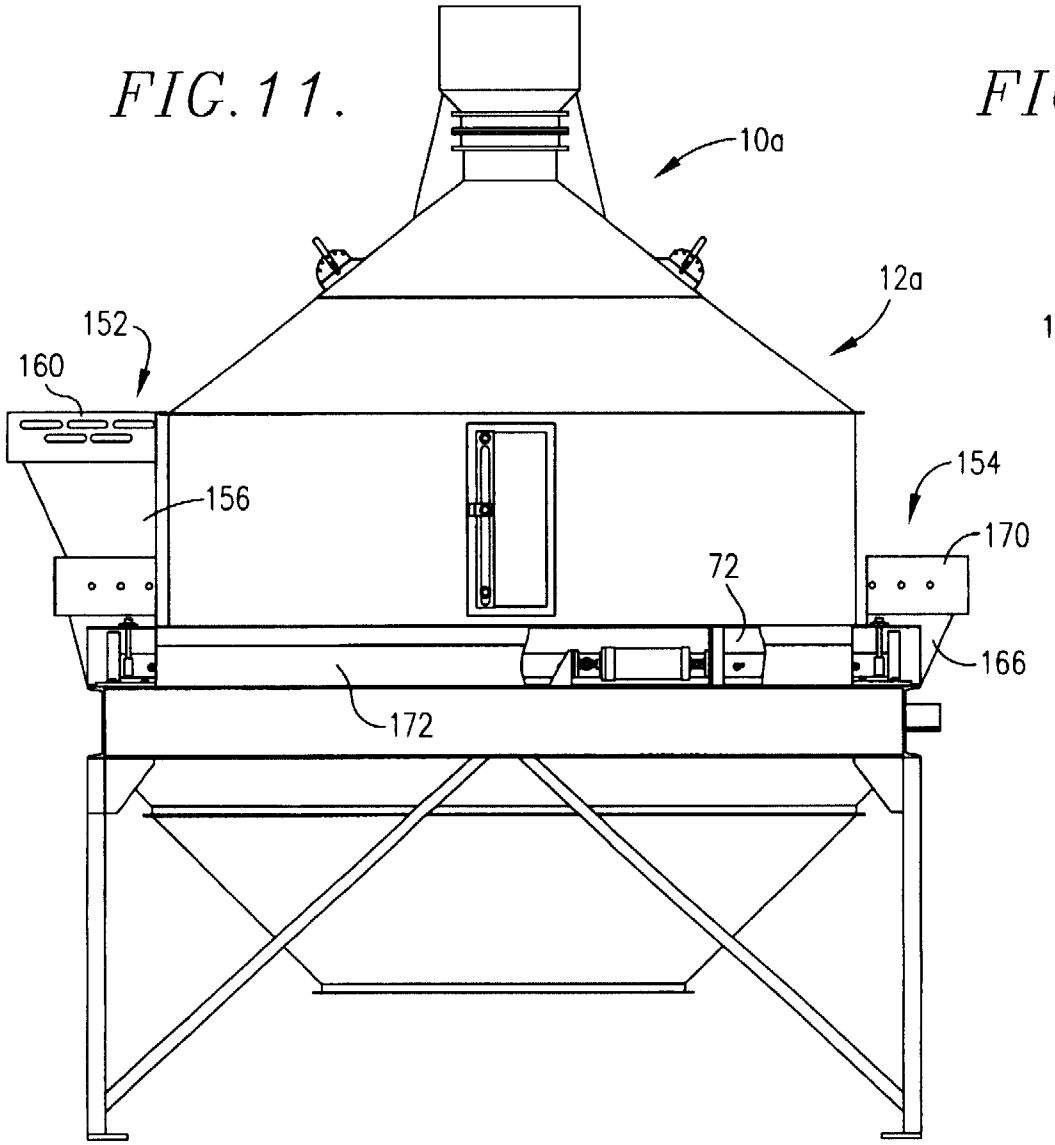
FIG. 11 is a side view similar to that of FIG. 1, but illustrating another embodiment in accordance with the invention wherein the device is equipped with opposed hot and cool air inlet structure along the opposed ends of the bin.
Figure 13:
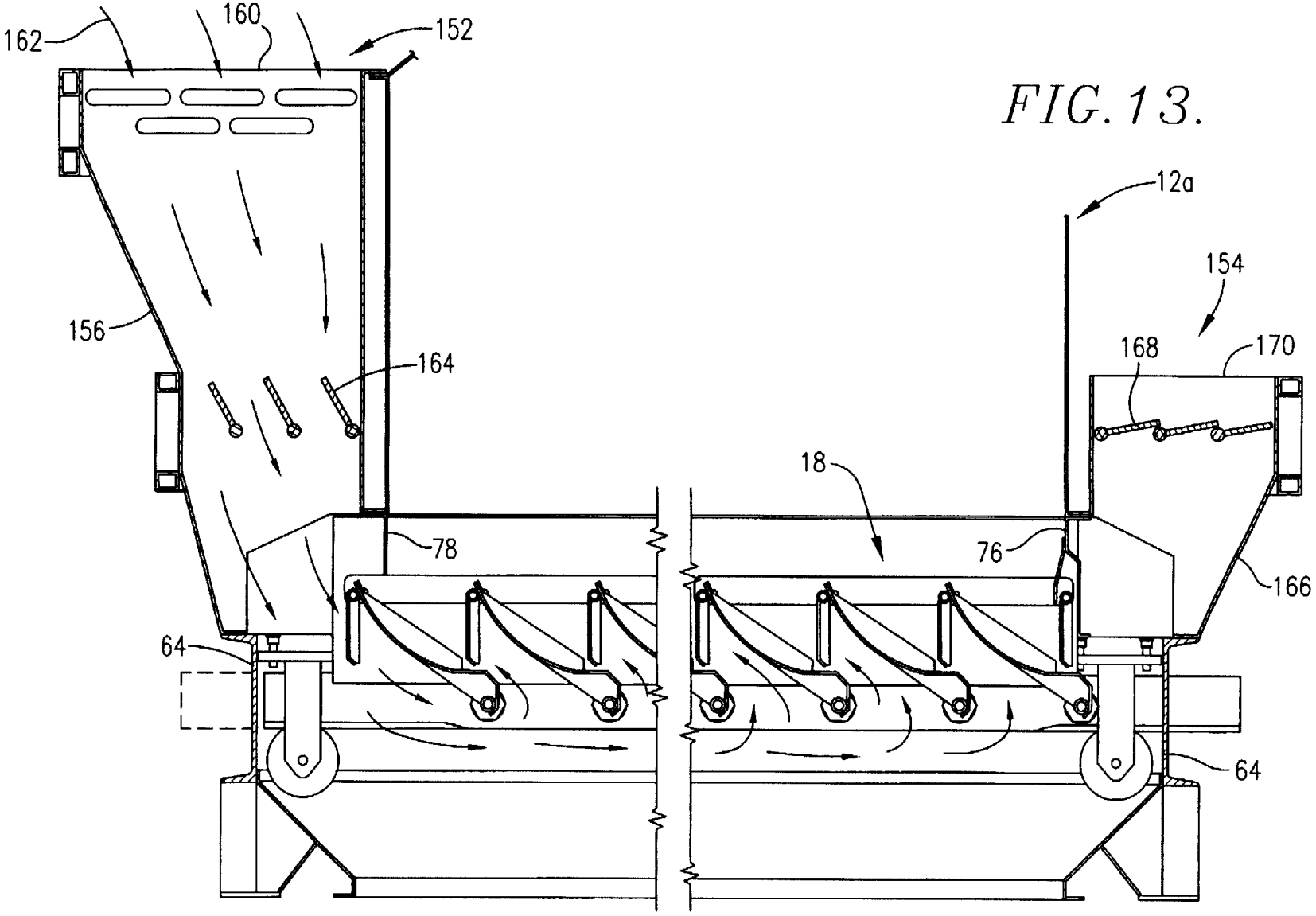
FIG. 13 is a fragmentary view in vertical section illustrating the alternate hot/cool air flow operation of the device illustrated in FIGS. 11–12.

A second embodiment of the invention is illustrated in FIGS. 11–13. In this case a device **10*a* is depicted which is identical in all respects with device 10 described above, except for the provision of relatively hot air inlet assembly 152 and relatively cool air inlet assembly 154 disposed on opposite ends of the bin 12*a*. Accordingly, the FIGS. 11–13 embodiment will be described in detail only to the extent necessary to fully explain the construction and operation of the assemblies 152,154**.

The hot air inlet assembly 152 includes an upright, hollow inlet manifold 156 extending the entire length of the end of bin **12*a* and secured respectively to the upper flange of the adjacent channel 64 and to bin extension wall 78. As shown, the interior of manifold 156 thus communicates with the interior of bin 12*a* beneath dual grate assembly 18. A series of steam heating coils 158 are disposed across the inlet 160 of manifold 156, in order to heat incoming ambient air currents 162. In addition, a series of selectively operable pivotal dampers 164 are located within manifold 156** and are designed for selectively closing the later to prevent any significant air flow through the manifold.

The cool air inlet assembly 154 is disposed along the opposite end of bin **12*a* and likewise includes an upright, open-toped manifold 166 coupled to the upper flange of the proximal channel 64 and to bin extension wall 76. A series of pivotal, selectively operable dampers 168 are situated within the confines of manifold 166 below the air inlet 170** thereof.

The device **10*a* is completed by provision of a pair of elongated sheet metal covers 172 respectively extending along the sides of bin 12*a* in covering relationship to the channels 72 and related adjacent structure. In this fashion, air is prevented from passing through the side wall regions of the device 10*a*, and thus air can only be introduced through the hot and cool air assemblies 152,154**.

In operation, the assemblies 152, 154 are operated in an alternate fashion so as to alternately and successively deliver relatively hot and relatively cool air currents beneath grate assembly 18 for passage upwardly therethrough so as to dry and cool the pellets within bin **12*a*. It will of course be appreciated that the duct and fan assembly 38 continually draws air currents through the assembly 18 and bin 12*a*, and that such air currents are alternately supplied by opening and closing of the assemblies 152, 154. Thus, during operation of the assembly 152 the damper 168 is closed; alternately, when air is passing through assembly 154, the damper 164** is closed. In practice, the air currents entering assembly 152 are heated to a temperature of from about 100°–300° F., and more preferably from about 150°–250° F. The hot air currents are normally delivered for longer periods of time than the cool air currents. For example, the hot air currents may be delivered for a period of from 2–20 minutes, more preferably from about 8–15 minutes. On the other hand, the cool air currents may be delivered for a period of from about 1–15 minutes, more preferably from about 3–10 minutes.

We claim:

1. A method of conditioning preformed discrete pellets comprising the steps of:

(a) providing a pellet conditioning device including an upright bin adapted to hold a quantity of pellets to be conditioned, a pellet inlet, a pellet outlet, and a selectively operable grate assembly within the bin and between said inlet and said outlet;

(b) introducing a quantity of pellets into said bin through said inlet, and causing the pellets to be supported within the bin on said grate assembly;

(c) directing relatively hot currents of air through said quantity of pellets, and then terminating the relatively hot current air flow;

(d) after substantial termination of said relatively hot current air flow, directing relatively cool currents of air through said quantity of pellets, the flow paths of said relatively hot and relatively cool currents of air through said quantity of pellets being generally cocurrent relative to each other; and (e) continuing the alternate direction of said relatively hot and relatively cool air currents through said quantity of pellets for conditioning thereof.

2. The method of claim 1, said grate assembly being provided with a plurality of air flow passages therethrough, said relatively hot and cool currents of air being directed upwardly through the grate assembly for passage through said quantity of pellets.

3. The method of claim 1, including the step of passing said relatively hot currents through said quantity of pellets for a period of from about 2–20 minutes.

4. The method of claim 3, said period being from about 8–15 minutes.

5. The method of claim 1, including the steps of passing said relatively cool currents through said quantity of pellets for a period of from about 1–15 minutes.

6. The method of claim 5, said period being from about 3–10 minutes.

7. The method of claim 1, including the step of supporting said quantity of pellets at a single location within said bin.

8. Apparatus for conditioning of pellets, comprising:

an upright bin adapted to receive a quantity of pellets to be conditioned and including a pellet inlet, a pellet outlet, and a selectively operable grate assembly disposed within the bin between said inlet and said outlet; and a conditioning assembly including means for introducing relatively hot currents of air through said quantity of pellets, and for terminating the flow of said relatively hot air currents therethrough;

means for introducing relatively cool air currents through said quantity of pellets, after the substantial termination of flow of said relatively hot air currents therethrough, with the flow paths of said relatively hot and relatively cool currents of air being substantially cocurrent relative to each others; and means for alternately directing said relatively hot and relatively cool air currents through said quantity of pellets for conditioning thereof.

9. The apparatus of claim 8, said air current introduction means comprising a hot air inlet assembly in communication with said bin below said quantity of pellets and comprising means for heating of incoming ambient air currents prior to entrance thereof into said bin.

10. The apparatus of claim 9, said heating means comprising a plurality of steam heated coils within said hot air inlet assembly.

11. The apparatus of claim 9, including damper means for selectively blocking air flow through said hot air inlet assembly.

12. The apparatus of claim 8, said air current introduction means comprising a cool air inlet assembly in communication with said bin below said quantity of pellets, said cool air inlet assembly including damper means therein for selectively blocking air flow through said cool air inlet assembly.

13. The apparatus of claim 8, said grate assembly being the sole support for said quantity of pellets within said bin.

* * * * *